US007426896B2

(12) United States Patent
West

(10) Patent No.: US 7,426,896 B2
(45) Date of Patent: Sep. 23, 2008

(54) PRONE OPERATOR POSITION PERSONAL WATERCRAFT

(75) Inventor: John H. West, Whitewater, WI (US)

(73) Assignee: Bomboard LLC, Whitewater, WI (US)

( * ) Notice: Subject to any disclaimer, the term of this patent is extended or adjusted under 35 U.S.C. 154(b) by 22 days.

(21) Appl. No.: 11/446,653

(22) Filed: Jun. 5, 2006

(65) Prior Publication Data

US 2007/0277719 A1 Dec. 6, 2007

(51) Int. Cl.
*B63B 35/73* (2006.01)
*B63B 25/00* (2006.01)

(52) U.S. Cl. ..... 114/55.58; 114/246

(58) Field of Classification Search ..... 114/55.58
See application file for complete search history.

(56) References Cited

U.S. PATENT DOCUMENTS 4,020,782 A 5/1977 Gleason
4,350,113 A 9/1982 Moreau et al.
4,875,426 A 10/1989 Soga et al.
D307,258 S 4/1990 Monostory
4,932,347 A 6/1990 Mardikian
5,096,446 A * 3/1992 Tazaki et al. ..... 440/38
5,251,439 A 10/1993 Nakase et al.
5,255,625 A 10/1993 Hattori
5,362,269 A 11/1994 Leach
5,388,543 A 2/1995 Ditchfield
5,394,820 A 3/1995 Dach
5,399,111 A 3/1995 Kobayashi et al.
5,429,534 A * 7/1995 Cano ..... 440/88 R
5,582,529 A 12/1996 Montgomery
5,782,664 A 7/1998 Casters
6,192,817 B1 2/2001 Dec et al.
6,237,522 B1 5/2001 Kiyohara et al.
6,247,422 B1 6/2001 Murray, III
6,375,527 B2 * 4/2002 Gohara ..... 440/89 R
D509,784 S 9/2005 Chase
2002/0056408 A1 5/2002 Dec et al.
2005/0268833 A1 12/2005 Conrad
2007/0125285 A1 6/2007 Conrad

OTHER PUBLICATIONS

Partial European Search Report, PCT/EP07252268, completion date Oct. 11, 2007.

* cited by examiner

*Primary Examiner*—Jesús D Sotelo
(74) *Attorney, Agent, or Firm*—Boyle Fredrickson, S.C.

(57) ABSTRACT

Personal watercraft systems are described. The personal watercraft systems include a housing for supporting a water jet engine system. The housing has a pickle fork shaped hull for operation enjoyment. A pair of sponsons is removably attachable to the housing to facilitate breakdown of the watercraft system assembly into more easily transportable components. A cowling is disposed in the housing about the water jet engine system for forming a water jacket about the engine. A support is attached to the housing to support a torso area of an operator. A seal is disposed between the support and the housing for sealing the interface therebetween and absorbing impacts. A steering mechanism is connected to the personal watercraft system for allowing an operator to control the personal watercraft systems direction of travel. The steering mechanism is located below the support for preventing inadvertent operator contact therewith. The systems provide advantages in greater operator comfort and enjoyment from operation of personal watercraft.

19 Claims, 3 Drawing Sheets

PRONE OPERATOR POSITION PERSONAL WATERCRAFT

BACKGROUND OF THE INVENTION

1. Field of the Invention

The present invention relates generally to the field of watercrafts and, more particularly, to jet-powered personal watercraft (PWC). Specifically, a preferred embodiment of the present invention relates to jet-powered personal watercraft constructed for operation by an operator in a prone position. The present invention thus relates to a personal watercraft of the type that can be termed prone operator position jet-powered watercraft.

2. Discussion of the Related Art

Historically, it was known in the prior art to provide a jet-powered personal watercraft of the type generally hereunder consideration. A conventional personal watercraft is typically understood as a watercraft constructed to support one operator and possibly as many as two passengers. Typically, the operator is oriented in a standing or seated position. For example, a personal watercraft constructed to support a passenger in addition to an operator generally requires a configuration wherein the passenger and the operator are positioned in a seated orientation. Providing a personal watercraft where the operator is supported in a prone position provides a personal watercraft that is uniquely controllable and operable, thereby overcoming what may be perceived as the tedium associated with conventional personal watercraft.

Another drawback of conventional personal watercraft is the relative size thereof. A majority of such watercraft are constructed to support an operator and/or passengers at a position above a surface of the water of the operating environment. Such operation requires the personal watercraft be constructed of sufficient size to provide a buoyant force equal to the weight of the personal watercraft, as well as the weight of the operator and/or passengers. Accordingly, such conventional personal watercrafts are relatively bulky. The size of such devices complicates non-operating transportation of the watercraft.

Another drawback of known personal watercraft systems is the relatively monolithic construction of such devices. Such devices commonly include a plurality of components, including an engine disposed within a one-piece waterproof hull. Frequently removing components from within the hull is a time consuming and laborious process. Furthermore, servicing of the components of the personal watercraft requires either removal of the component directly therefrom or transportation of the entirety of the personal watercraft. Such transportation is commonly facilitated via a trailer, which is configured to directly support the personal watercraft. That is, such watercraft is substantially non-shippable. The relatively unitary construction of such assemblies prevents convenient and economical transportation of the personal watercraft for servicing and the like. Such devices are commonly locally serviced due in part to the inconvenient transportation of the device or components thereof.

Therefore, it would be desirable to design a personal watercraft constructed to support an operator in a prone position, which is separable and therefore easily transportable.

SUMMARY OF THE INVENTION

By way of summary, the present invention is directed to a personal watercraft constructed to support an operator in a prone position that overcomes the aforementioned drawbacks. The personal watercraft system includes a housing for supporting a water jet engine system. The housing has a pickle fork shaped hull for operation enjoyment. A pair of sponsons is removably attachable to the housing to facilitate breakdown of the watercraft system assembly into more easily transportable components. Within the water jet engine system, a water jacket or sleeve surrounds the engine. A support or cowling is attached to the top of the housing to support a torso area of an operator and a seal is disposed between the cowling/support and the housing for sealing the interface therebetween and absorbing operator impacts with the support. A steering mechanism is connected to the personal watercraft system for allowing an operator to control the direction of travel of the personal watercraft system. The steering mechanism is located below the support for preventing inadvertent operator contact therewith. The system provides for greater operator comfort and enjoyment of operation of the personal watercraft.

Therefore, according to one aspect of the present invention, a personal watercraft having a body with a topside and a pickle fork shaped underside is disclosed. A cover is movably connected to the topside of the body and a plurality of floats are removably connected to the body. The personal watercraft includes a sleeve surrounding a water jet engine for cooling the water jet engine and a steering mechanism for directing a water jet.

According to another aspect of the present invention, a watercraft apparatus is disclosed, which includes a housing for enclosing an engine. The watercraft apparatus has a water jet for propelling the watercraft and a panel for supporting a chest area of an operator. The apparatus includes a gasket for sealingly attaching the panel to the housing and for allowing deflection of the panel relative to the housing.

According to another aspect of the present invention, a personal marine system having an enclosure for engaging a water surface is disclosed. The system includes an engine disposed in the enclosure and an engine for propelling the personal marine system. The system preferably includes a sleeve/membrane positionable between the engine and the enclosure for forming a water jacket about the engine.

These and other aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
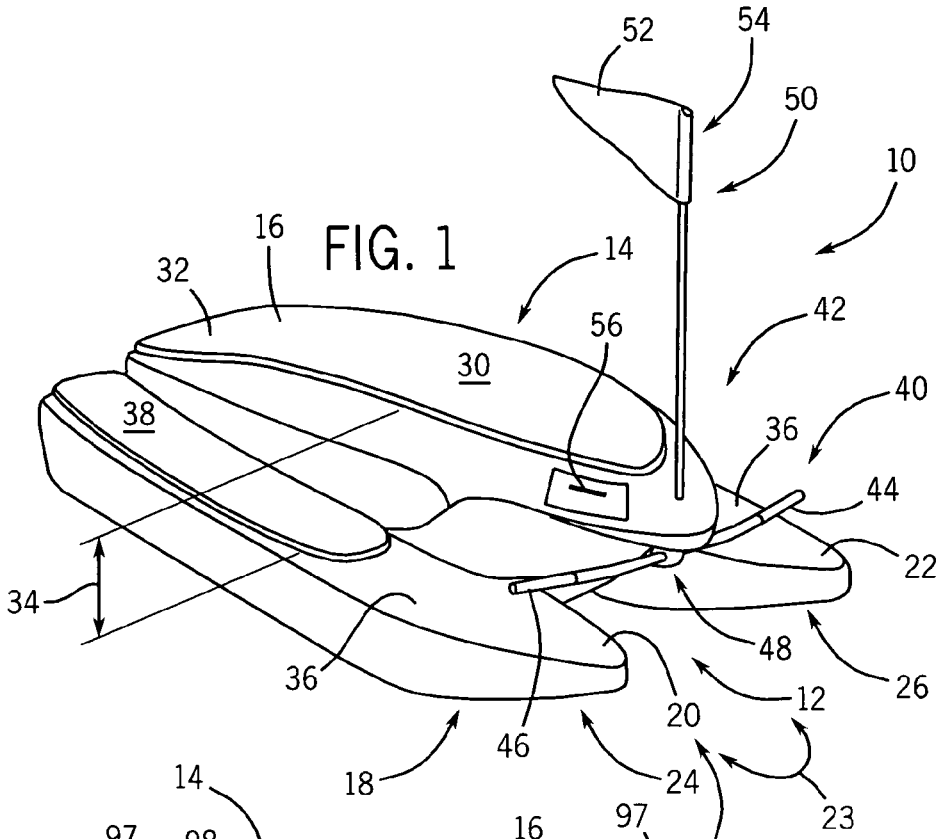
FIG. 1 shows a perspective view of a personal watercraft according to the present invention.

In describing the preferred embodiment of the invention that is illustrated in the drawings, specific terminology will be resorted to for the sake of clarity. However, it is not intended that the invention be limited to the specific terms so selected and it is to be understood that each specific term includes all technical equivalents that operate in a similar manner to accomplish a similar purpose. For example, the word connected or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

The above-mentioned requirements of operability and transportability are mutually contradicting and cannot be satisfied simultaneously in the case of conventional personal watercraft. However, it is rendered possible to simultaneously satisfy these requirements to a certain extent by employing a separable component hull in consideration of the fact that a user operates the personal watercraft in a prone position.

Personal watercraft systems are described herein. The personal watercraft systems preferably include a housing for supporting a water jet engine system. The housing has a pickle fork shaped hull for operation enjoyment. A pair of sponsons is removably attachable to the housing to facilitate breakdown of the watercraft system assembly into more easily transportable components. The water jet engine system has a water jacket about the engine. A cowling with a support is attached to the housing to support a torso area of an operator. A seal is disposed between the cowling and the housing for sealing the interface therebetween and absorbing impacts. A steering mechanism is connected to the personal watercraft system for allowing an operator to control the personal watercraft systems direction of travel. The steering mechanism is located below the hull and cowling for preventing inadvertent operator contact therewith. The systems provide advantages in greater operator comfort and enjoyment from operation of personal watercraft.

Therefore, one embodiment of the present invention includes a personal watercraft having a body with a topside and a pickle fork shaped underside. A cover or cowling is movably connected to the topside of the body and a plurality of floats is removably connected to the body. The personal watercraft includes a sleeve/membrane surrounding a water jet engine for cooling the water jet engine and a steering mechanism for directing a water jet.

A further embodiment of the invention includes a watercraft apparatus that has a housing for enclosing an engine. The watercraft apparatus has a water jet for propelling the watercraft and a panel for supporting a chest area of an operator. The apparatus includes a gasket for sealingly attaching the panel to the housing and for allowing deflection of the panel relative to the housing.

Another embodiment of the invention includes a personal marine system having an enclosure for engaging a water surface is disclosed. The system includes an engine disposed in the enclosure and a water jet powered by the engine for propelling the personal marine system. The system includes a sleeve positionable between the engine and the enclosure for forming a water jacket about the engine.

2. Detailed Description of Preferred Embodiments

FIG. 1 shows a watercraft apparatus, preferably a personal marine system, such as a personal watercraft 10 according to the present invention. Personal watercraft 10 includes a body, for example, a housing, enclosure, or hull assembly 12 constructed to allow flotation and planing of personal watercraft 10 upon a water surface. Hull assembly 12 includes a plane, e.g., surface or topside 14 having a panel, such as a cover or cowling 16 including a preferably padded seat 17 pivotably connected thereto. Seat 17 is constructed and configured to engage a torso, e.g., an operator torso or a chest area during operation of the personal watercraft 10. A bottom surface or bottom side 18 of body or hull assembly 12 is constructed to engage a water surface such that, during operation of personal watercraft 10, a bottom side 18 of personal watercraft 10 planes across a surface of the operating environment, e.g., a lake.

A plurality of floats or sponsons 20, 22 is removably attached to hull assembly 12. Sponsons 20, 22 form a first protrusion 24 and a second protrusion 26 on bottom side 18 of personal watercraft 10. As such, sponsons 20, 22 cooperatively form a unique shape 28 of bottom side 18. Preferably, this shape forms a generally V-shaped or a pickle fork shaped underside 23 of hull assembly 12. Sponsons 20, 22 are watertight and adjust the buoyancy of personal watercraft 10. Sponsons 20, 22 are constructed with a lightweight waterproof construction such that sponsons 20, 22 resist impact deterioration and water penetration thereof. Preferably, sponsons 20, 22 and hull assembly 12 are constructed of a thermoformed ABS sheet material with weatherable cap, thereby providing a lightweight and robust construction. A flotation foam is disposed within the thermoformed ABS material of sponsons 20, 22, thereby providing a lightweight sponsor construction that is sufficiently rigid to withstand impacts thereof. Furthermore, pickle fork shape 28 provides user control and operation of personal watercraft 10 that is foreign to known personal watercraft. Furthermore, protrusions 24, 26 reduce operator impact associated with operation over rough water, such as wakes and/or waves. Pickle fork shape 28 formed by removable sponsons 20, 22 stabilizes operation of the personal watercraft 10 and provides a unique personal watercraft experience.

Seat 17 is preferably formed from a closed foam 30, which provides a first suspension feature 32 of the present invention. That is, seat 17 is constructed to absorb some of the impact associated with operator separation therefrom. Seat 17 is elevated a variable distance 34 above an upper surface 36 of sponsons 20, 22. A pad 38 is attached to upper surface 36 of each sponsor 20, 22 and is configured to engage an operator's knees and shins or elbows and forearms providing for variable prone operator orientations.

A maneuvering system or steering mechanism 40 passes through hull assembly 12 proximate a forward portion 42 thereof. A control, e.g., a handle, or handlebar 44 is connected to personal watercraft 10 within distance 34 between topside 14 of hull assembly 12 and upper surface 36 of sponsons 20, 22. Handlebar 44 is offset from topside 14 of hull assembly 12. A throttle control 46 is preferably connected to handlebar 44 and is constructed to control an operating speed of an engine of personal watercraft 10. Rotation of handlebar 44 about a pivot 48 controls a direction of discharge of water from a water jet pump of personal watercraft 10 and thereby controls the direction of travel of personal watercraft 10 similar to a motorcycle and/or bicycle steering control. An operator can comfortably rest his or her chest upon seat 16 with their arms extended forward over sponsons 20, 22 and engaged with steering mechanism 40. As such, an operator can non-strenuously control the speed and direction of the operation of personal watercraft 10.

An optional pendant 50 is connected to personal watercraft 10 and extends above topside 14 thereof. A flag 52 is attached proximate an end 54 of optional pendant 50, thereby enhancing the visibility of personal watercraft 10 when operated upon a water surface. Hull assembly 12 also includes an optional storage compartment 56 pivotably connected thereto. Optional storage compartment 56 is pivotably connected to the hull assembly such that users thereof can conveniently store other recreational accessories, such as sunglasses and/or sunscreen. Storage compartment 56 is also constructed to retain an optional strap that is further discussed with respect to FIG. 4. Storage compartment 56 sealingly engages hull assembly 12 such that items stored therein remain dry during operational use of personal watercraft 10. Alternatively, it is appreciated that storage compartment 56 be formed in one or both of sponsons 20, 22.

Figure 2:
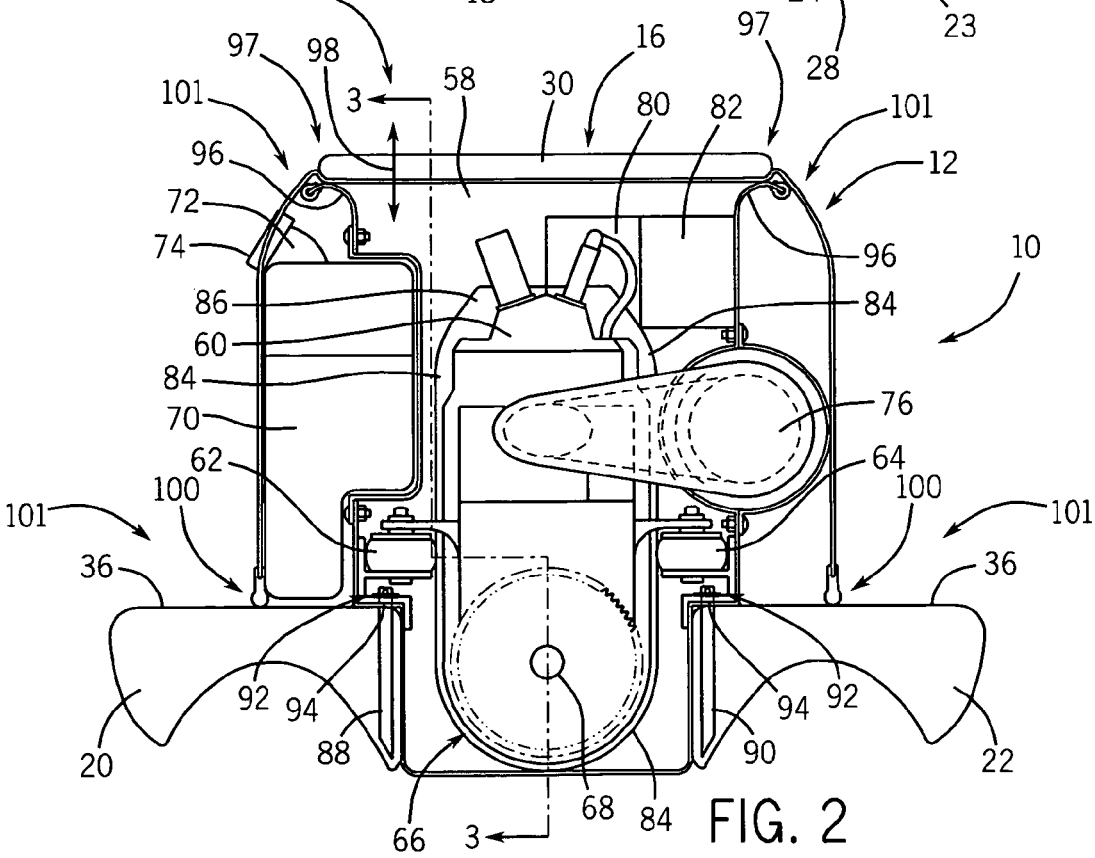
FIG. 2 is an elevational view of a cross-section of the personal watercraft shown in FIG. 1.
Figure 3:
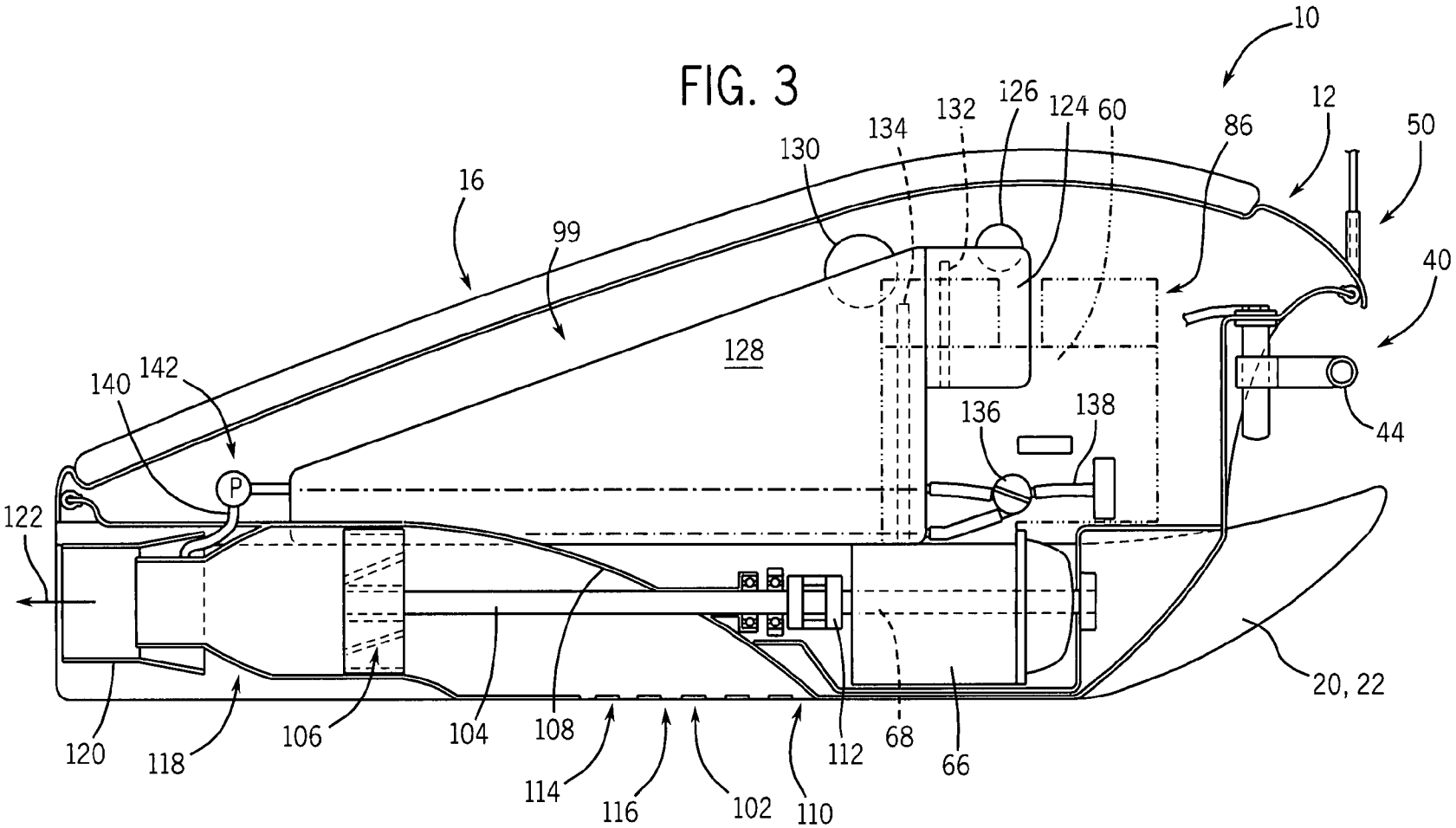
FIG. 3 is an elevational view of a cross-section of the personal watercraft shown in FIG. 2 taken along line 3-3.

FIG. 2 shows a cross-section of personal watercraft 10 exposing an engine compartment 58 formed by hull assembly 12. An engine 60 is disposed within engine compartment 58 and a plurality of engine mounts 62, 64 secure engine 60 thereto. Engine 60 includes a crankcase 66 having a crankshaft 68 that extends therefrom and is operably connected to a water jet pump that is described further with respect to FIG. 3. Preferably, engine 60 is a two-cycle engine, although other engine configurations, such as a four-cycle engine, would perform equally as well. Understandably, modification to the engine will affect the weight, and therefore the transportability, of personal watercraft 10. A fluid reservoir 70 includes a fill neck 72, which sealingly passes through hull assembly 12, thereby allowing an operator to fill fluid reservoir 70 without removing any components of personal watercraft 10 other than a reservoir cap 74. Understandably, depending on the configuration of engine 60, fluid reservoir 70 is configured to contain oil, fuel, or an oil/fuel mixture. Where fluid reservoir 70 contains one of oil or fuel, an additional fluid reservoir is provided for the alternate fluid. Understandably, if fluid reservoir 70 is constructed to contain fuel, engine 60 can be constructed to include an oil reservoir within crankcase 66 or, alternatively, the additional fluid reservoir previously disclosed can be provided. Preferably, personal watercraft 10 includes separate and removable engine fluid reservoirs as shown in FIG. 3. Still referring to FIG. 2, engine 60 is fluidly connected to an expansion chamber 76, which communicates combustion byproducts from engine 60 to atmosphere. A spark plug 78 is connected to an ignition control system 80, which is connected to a battery 82. Such a configuration facilitates electronic starting of engine 60. Alternatively, personal watercraft 10 could be equipped with a pull start.

A sleeve 84 snugly surrounds engine 60, and is constructed to have cooling water passed therebetween forming a watertight area or a water jacket 86 about engine 60. Preferably, sleeve 84 is lightweight and pliable, thereby allowing the weight of engine 60 to be reduced by removing the cooling function structure commonly associated therewith. More preferably, sleeve 84 is formed of a thermoplastic material formed around engine 60. Commonly such engines include a water jacket that is integrally formed in the engine or a plurality of fins that extend from the engine and are constructed to dissipate operational heat therefrom. Although such constructions provide a relatively robust engine, such constructions also substantially increase the weight of the watercraft. Referring back to FIG. 2, cooling water is circulated through water jacket 86 from an operating environment and returned thereto, thereby allowing the cooling fluid to be removed from personal watercraft 10 during non-operation. That is, engine 60 is constructed without integral cooling fins or a closed loop cooling system thereby providing a comparatively lightweight engine powered water jet powered personal watercraft. Understandably, the spacing between engine 60 and sleeve 84 is determined to provide adequate water-cooling of engine 60 without requiring excessive water flow through personal watercraft 10.

A securing means or pin 88, 90 is secured to each of sponsons 20, 22 and is removably engaged with personal watercraft 10. The head portion 92 of each pin 88, 90 passes through an opening 94 formed in hull assembly 12, extends into engine compartment 58, and is secured thereat. Understandably, any of the nut, hole and roll or cotter pin, or associated threaded engagement removably secures pins 88, 90 to hull assembly 12. Preferably, pins 88, 90 are toollessly attached and removed from personal watercraft 10. Head portions 92 extend through hull assembly 12 fore or aft of engine mounts 62, 64 such that an operator can conveniently and expeditiously remove sponsons 20, 22 from personal watercraft 10 when so desired.

Proximate topside 14 of personal watercraft 10, a deflector, e.g., gasket or seal 96 is disposed between seat 17 and cowling 16 and hull assembly 12. This seals a joint 97 therebetween. Seal 96 is deformable and/or deflectable such that, during operation of personal watercraft 10, seat 16 deflects in a direction, indicated by arrow 98, responsive to operator impacts therewith. Another deflector, e.g., seal 100 engages sponsons 20, 22 and functions substantially similar to seal 96. That is, seal 100 both seals the connection between hull assembly 12 and sponsons 20, 22 and absorbs a portion of the shock associated with operator impact with seat 17. Accordingly, in conjunction with first suspension feature 32, seals 96, 100 of personal watercraft 10 are constructed to provide a second suspension feature 101 for further reducing any operational impacts that may be communicated to an operator.

FIG. 3 shows a cross-section of personal watercraft 10 taken along line 3-3 shown in FIG. 2. A water jet engine or engine powered water jet 99 is connected to hull assembly 12. Personal watercraft 10 includes a water jet, e.g., a jet pump assembly 102 having a shaft 104 and an impeller 106 connected to the shaft. Shaft 104 extends through a wall 108 of a tunnel 110 of jet pump assembly or barrel 102. Preferably, shaft 104 and impeller 106 are formed of a fiber glass, a fiber wrapped, or a molded plastic material. An end 112 of shaft 104 is operatively connected to crankshaft 68 of engine 60. During rotation of impeller 106, water is drawn through a grate 114 positioned over an inlet 116 of tunnel 110. Grate 114 prevents debris or other materials from entering tunnel 110 and interfering with the operation of impeller 106. Water is drawn through inlet 116 by impeller 106, passes through a venturi section 118 of jet pump assembly 102, and into and through a steerable nozzle 120 that is pivotably connected to jet pump assembly 102. Nozzle 120 is operatively connected to steering mechanism 40 such that operator manipulation of handlebar 44 results in movement of steerable nozzle 120, to direct the direction of a water jet or discharge, indicated by arrow 122, from nozzle 120. The direction of discharge 122 controls the direction of travel of the personal watercraft 10. Accordingly, an operator positioned upon seat 16 can easily and efficiently control the direction and speed of travel, of personal watercraft 10 via manipulation of handlebar 44 and throttle control 46.

An oil tank or oil reservoir 124 is disposed within hull assembly 12 and includes a fill neck 126, which extends therethrough. A gas or fuel tank 128 is also disposed within housing or hull assembly 12, and also includes a fill neck 130 that extends therethrough. Oil reservoir 124 and fuel tank 128 each include a level indicator 132, 134, respectively, such as a sight tube, to indicate the fluid level contained therein. Additionally, it is further understood that hull assembly 12 includes an optional transparent portion (not shown) such that the level of oil reservoir 124 and fuel tank 128 can be assessed without disassembly or movement of any components of personal watercraft 10. Oil reservoir 124 and fuel tank 128 are operatively connected to engine 60 via a mixing valve assembly 136. Understandably, for those engine constructions wherein engine oil is contained within a reservoir of crankcase 66, mixing of engine oil with fuel is unnecessary. Mixing valve assembly 136 fluidly isolates oil reservoir 124, fuel tank 128, and engine 60 when valve assembly 136 is oriented in a "closed" position. Such a construction allows oil reservoir 124 and fuel tank 128 to be removed from personal watercraft 10 without emptying the reservoir and tank via separation of connection line 138. Accordingly, for servicing of personal watercraft 10, sponsons 20 and 22 along with the cowling 16 and sear 17 can be removed from the body or power pod 12, as well as oil reservoir 124 and fuel tank 128, thereby providing a comparatively lightweight subassembly, which can be conveniently shipped for servicing thereof.

Proximate the venturi section 118 of jet pump assembly 102; a fluid line 140 fluidly connects a water flow through jet pump assembly 102 with water jacket 86. Alternatively, an optional pump 142 could be connected to fluid line 140 and constructed to extend through body or hull assembly 12, thereby fluidly connecting with the water jacket 86 of the operating environment. Accordingly, during non-operation of the personal watercraft 10, the engine cooling fluid is completely removed from personal watercraft 10, thereby reducing the non-operating transportation weight of personal watercraft 10.

3. In Use and Operation

Due to the compact construction of personal watercraft 10, the removable nature of sponsons 20, 22, and drainable engine cooling system, personal watercraft 10 is envisioned to be easily and conveniently transported by a single operator. That is, personal watercraft 10 preferably weighs less than approximately 80 pounds, and can be easily transported by a single operator. Furthermore, the removal of oil reservoir 124, fuel tank 128, cowling 16, and seat 17 facilitates even further weight reduction of the transportable portions of personal watercraft 10. That is, where an operator is incapable of individually transporting the approximately 80-pound assembly, the oil reservoir and the fuel tank can be removed therefrom and transported via a second user. The removable nature of the engine fluid containers also facilitates convenient shipping of personal watercraft 10 for remote servicing or more than portage transportation of personal watercraft 10.

Figure 4:
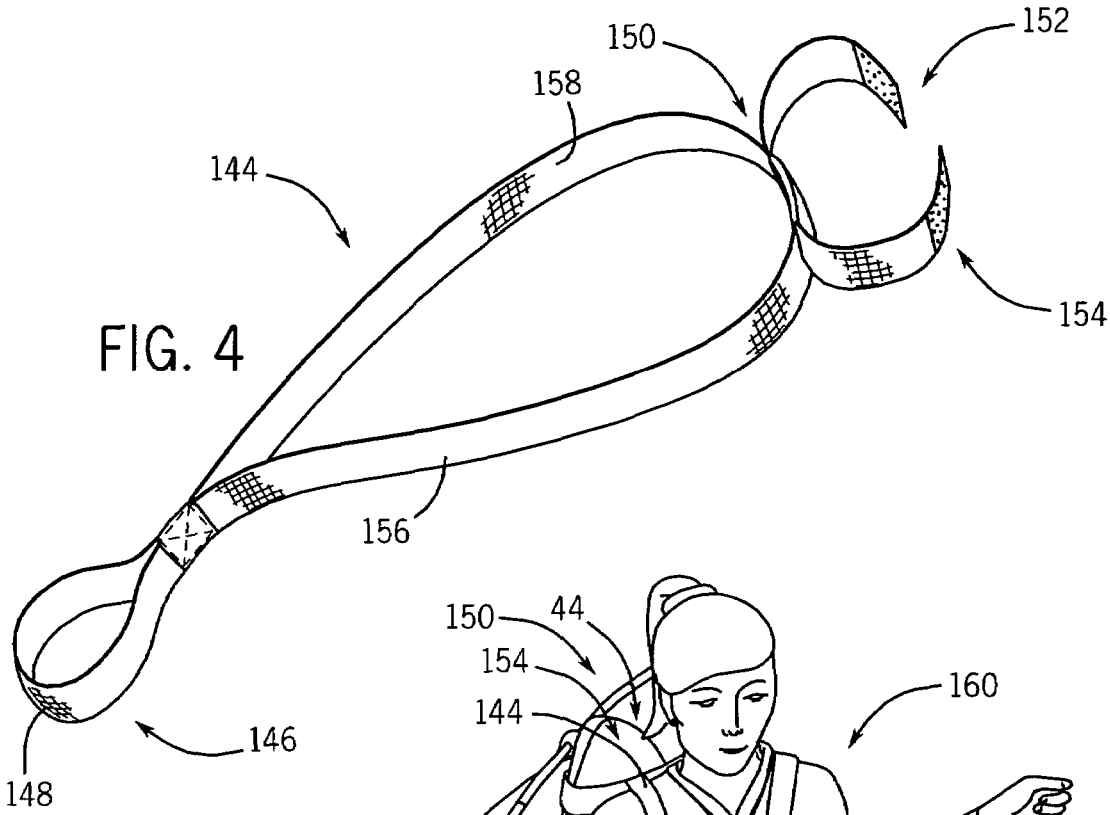
FIG. 4 is a perspective view of a strap assembly for use with the personal watercraft shown in FIG. 1.

As shown in FIG. 4, the present invention includes an optional removable strap 144 constructed to engage personal watercraft 10. Strap 144 has a first end 146 with a loop 148 formed thereat and a second end 150 having a separable loop 152 formed thereat. A snap clip assembly 154 separates loop 152 such that it can be positioned around handlebar 44 of personal watercraft 10. Loop 148 is constructed to slidably engage nozzle 120. A pair of shoulder straps 156, 158 extend between loop 148 and separable loop 152 and are constructed to engage an operator's shoulders such that, during non-operation of personal watercraft 10, an operator can simply transport the personal watercraft 10 in a backpack-type manner. Alternatively, it is also envisioned that sponsons 20, 22 or hull assembly 12 be equipped with associated wheel assemblies at an aft portion thereof such that an operator can simply transport the personal watercraft 10 in a manner substantially similar to rollable luggage.

Figure 5:
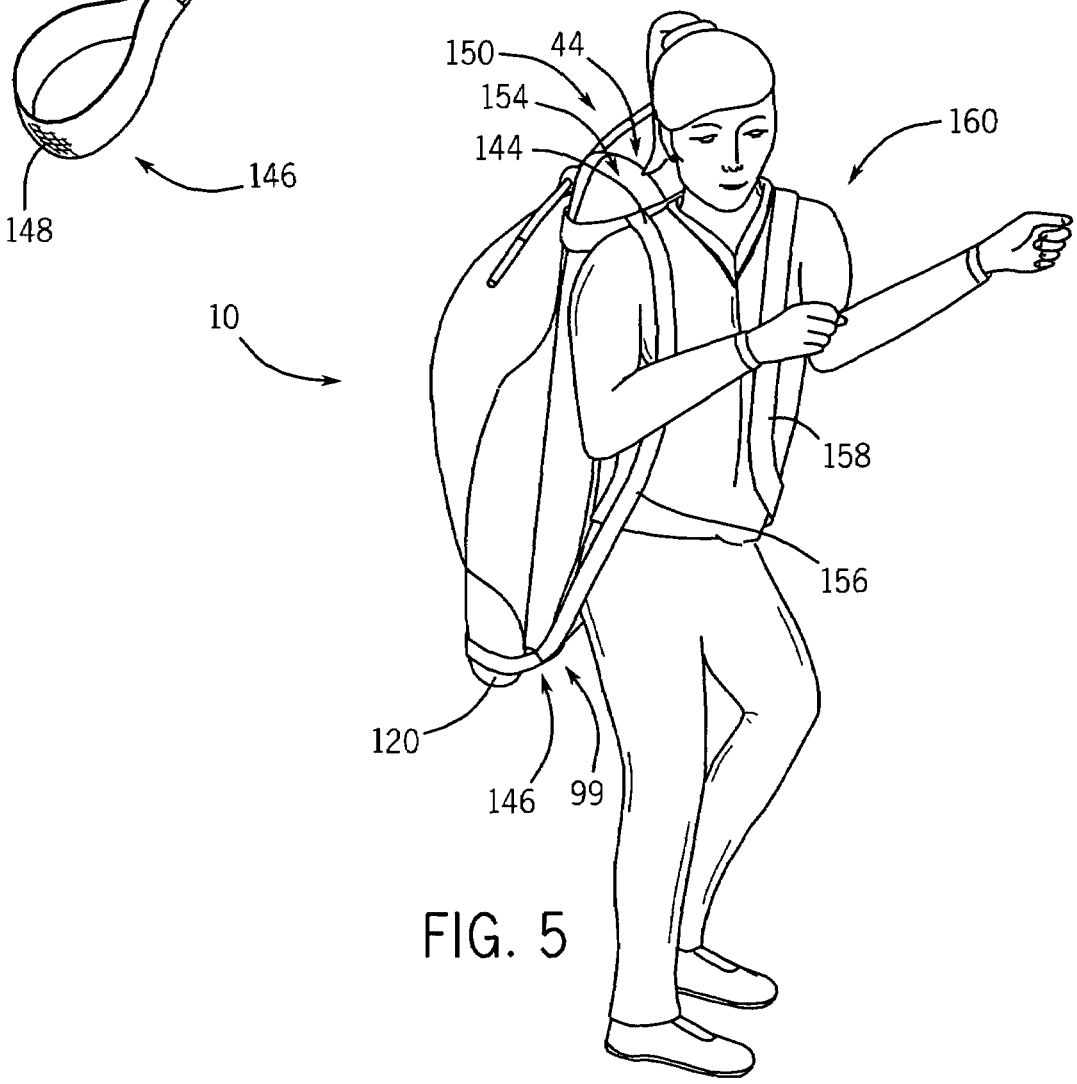
FIG. 5 is a perspective view of the personal watercraft shown in FIG. 1 with the sponsons removed from the watercraft and the strap assembly attached thereto.

As shown in FIG. 5, strap 144 facilitates expedient and efficient transportation of personal watercraft 10. First end 146 of strap 144 is positioned about nozzle 120 of water jet 99. Shoulder straps 156, 158 extend therefrom and are constructed to engage an operator 160. Second end 150 of strap 144 removably engages handlebar 44 via snap clip assembly 154. As shown in FIG. 5, the sponsons have been removed from personal watercraft 10, thereby reducing the load operator 160 is required to transport. Understandably, other operators may be able to transport personal watercraft 10 with the sponsons connected thereto.

In one embodiment, the hull assembly 12 may be made from a frame that is preferably constructed of hollow tubes formed in triangular configurations. The tubes are preferably made of aluminum, titanium, or some other rigid, strong and lightweight material. Such a tubular space frame is known in the Formula One racecar arena as well as in the construction of Bucatti motorcycles. Instead of a tubular frame, the frame may be made out of a honeycomb material. The frame may be also covered or skinned with fiberglass, rolled aluminum, or some other strong and lightweight material. In one embodiment, the tubular frame may actually protrude out from the skin and be visible to the eye.

In another embodiment, the water jet may include a barrel that encompasses the pump. The barrel may be inside the hull assembly or mounted under the space frame to the outside bottom portion of the space frame so that it is not actually inside the hull. Such a barrel may be mounted with fastening straps or bands directly to the hull assembly.

The present invention has been described in terms of the preferred embodiment, and it is recognized that equivalents, alternatives, and modifications, aside from those expressly stated, are possible and within the scope of the impending claims. It is intended that the appended claims cover all such additions, modifications and rearrangements. Expedient embodiments of the present invention are differentiated by the appended claims.

What is claimed is:

1. A personal watercraft comprising:

a body having a top side;

a cover connected to the top side of the body;

a support pad for an operator chest on the top side of the body;

a plurality of floats removably connected to the body;

a water jet engine disposed in the body; and a mechanism for steering the personal watercraft.

2. The personal watercraft of claim 1 further comprising a deflector for flexibly attaching the cover to the body and sealing a joint therebetween.

3. The personal watercraft of claim 1 wherein the personal watercraft weighs less than approximately 80 pounds.

4. The personal watercraft of claim 3 further comprising a strap for removably attaching to the personal watercraft for carrying.

5. The personal watercraft of claim 1 wherein the steering mechanism includes a control disposed below a plane of the cover.

6. The personal watercraft of claim 1 further comprising a gas tank removably connected to the body and constructed to be removed therefrom without emptying.

7. The personal watercraft of claim 1 wherein the cover is offset from a control of the steering mechanism.

8. The personal watercraft of claim 1, further comprising a seal for sealing the cover and for deflecting during operation of the personal watercraft.

9. A watercraft apparatus comprising:

a housing for enclosing an engine;

a water jet for propelling the watercraft;

a panel for supporting a chest area of an operator;

a gasket for sealingly attaching the panel to the housing and for allowing deflection of the panel relative to the housing; and a bottom surface that has a first protrusion and at least a second protrusion parallel to the first protrusion.

10. A personal marine system comprising:

an enclosure for engaging a water surface;

an engine having an external surface disposed in the enclosure;

a water jet powered by the engine for propelling the personal marine system;

a sleeve positionable between the engine and the enclosure;

a plurality of sponsons parallel the enclosure for stabilizing buoyancy once the system is on a water surface;

a water jacket defined by the sleeve and external engine surface for engine cooling; and a seal for sealing the enclosure and for deflecting during operation of the personal marine system.

11. The personal marine system of claim 10, further comprising a handlebar for directing a discharge of the water jet.

12. The personal marine system of claim 10, further comprising a pump for circulating water from an operating environment through the water jacket.

13. The personal marine system of claim 10, further comprising a support for engaging an operator torso.

14. The personal marine system of claim 10, further comprising a steering mechanism connected to the system for allowing an operator to control direction of travel of the system, and wherein the steering mechanism is configured for preventing inadvertent operator contact therewith.

15. The personal marine system of claim 10, further comprising a support located above the enclosure to a torso area of an operator and said seal being disposed between the support and the enclosure for sealing therebetween and absorbing impacts.

16. The personal marine system of claim 15, wherein the support is formed from a closed foam to provide a first suspension feature and further comprising a pad attached to an upper surface of each sponson and configured to engage an operator's limbs.

17. The personal marine system of claim 10, wherein the sponsons are removably detachable to sides of the enclosure to facilitate breakdown of the system into more easily transportable components.

18. The personal marine system of claim 10, further comprising a top plane on the enclosure, wherein the plane includes a padded seat pivotably connected thereto, and wherein the seat is constructed and configured to engage an operator torso during operation of the system.

19. The personal marine system of claim 10 wherein the sponsons are constructed of a thermoformed material and a flotation foam disposed within to provide a lightweight construction that is sufficiently rigid to withstand impacts thereof.

* * * * *